US008461767B2

(12) United States Patent
Canter et al.

(10) Patent No.: US 8,461,767 B2
(45) Date of Patent: Jun. 11, 2013

(54) POWER FACTOR CONTROL FOR AN LED BULB DRIVER CIRCUIT

(75) Inventors: Stanley Canter, Hermosa Beach, CA (US); John D. Grainger, Fremont, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 13/479,245

(22) Filed: May 23, 2012

(65) Prior Publication Data

US 2012/0313520 A1 Dec. 13, 2012

Related U.S. Application Data

(63) Continuation of application No. 13/155,345, filed on Jun. 7, 2011, now Pat. No. 8,188,671.

(51) Int. Cl.
*H05B 37/02* (2006.01)
*H01J 7/44* (2006.01)

(52) U.S. Cl.
USPC ..... 315/224; 315/186; 315/291; 315/294; 315/307; 315/308

(58) Field of Classification Search
USPC ..... 315/186, 224, 291, 294, 307, 308
See application file for complete search history.

(56) References Cited

U.S. PATENT DOCUMENTS 6,396,718 B1 5/2002 Ng et al.
7,633,779 B2 * 12/2009 Garrity et al. ..... 363/70
2005/0212501 A1 9/2005 Acatrinei
2005/0253533 A1 11/2005 Lys et al.
2007/0267984 A1 11/2007 Peng
2009/0021182 A1 1/2009 Sauerlaender
2009/0195186 A1 * 8/2009 Guest et al. ..... 315/294
2009/0295292 A1 * 12/2009 Harmgardt et al. ..... 315/51
2010/0207536 A1 * 8/2010 Burdalski et al. ..... 315/224
2010/0308742 A1 12/2010 Melanson
2011/0279044 A1 11/2011 Maiw

OTHER PUBLICATIONS

Non Final Office Action received for U.S. Appl. No. 13/155,345, mailed on Dec. 9, 2011, 10 pages.
Notice of Allowance received for U.S. Appl. No. 13/155,345, mailed on Mar. 21, 2012, 8 pages.
International Search Report and Written Opinion received for PCT Patent Application No. PCT/US2012/041404, mailed on Aug. 28, 2012, 9 pages.

* cited by examiner

*Primary Examiner* — Douglas W Owens
*Assistant Examiner* — Thai Pham
(74) *Attorney, Agent, or Firm* — Morrison & Foerster LLP

(57) ABSTRACT

A light-emitting diode (LED) bulb has a shell and a base attached to the shell. An LED is within the shell. A driver circuit provides current to the LED. The driver circuit has a power factor control circuit that includes a tracking circuit configured to produce a tracking signal indicative of the voltage of the supply line. The power factor control circuit also includes a switch-mode power supply (SMPS) controller having an input pin and an output pin. The tracking circuit is connected to the input pin. Based on the signal at the input pin, the SMPS controller is configured to change a duty cycle of an output signal on the output pin.

20 Claims, 8 Drawing Sheets

POWER FACTOR CONTROL FOR AN LED BULB DRIVER CIRCUIT

CROSS-REFERENCE TO RELATED APPLICATIONS

This application claims the benefit under 35 USC 120 of U.S. patent application Ser. No. 13/155,345, filed Jun. 7, 2011, published as U.S. Patent Publication No. 2011/0298375, and issued as U.S. Pat. No. 8,188,671, which is incorporated herein by reference in its entirety for all purposes.

BACKGROUND

1. Field

The present disclosure generally relates to a light-emitting diode (LED) driver circuit for use with LED bulbs, and more particularly, to and LED driver circuit with an improved power factor.

2. Description of Related Art

Despite the many benefits of LED bulbs, there are some challenges that have prevented LED bulbs from widely replacing incandescent and fluorescent bulbs in residential application. For example, electrically, LED bulbs operate differently than incandescent and fluorescent bulbs. LED bulbs are current controlled devices, meaning that the light output is control by changes in current as opposed to incandescent and fluorescent bulbs that are voltage controlled.

The difference in control requires that LED bulbs have special driver circuits that convert the standard AC voltage supplied in residential outlets to a current suitable for driving LEDs. These driver circuits, however, typically result in an LED bulb that interacts with the electrical grid very differently than incandescent bulbs.

Power factor is one significant parameter where LED bulbs differ from incandescent bulbs. Power factor is the ratio of real power flowing to a load to the apparent power. A load with a power factor of 1 means that the load is using all power being delivered to the load. Typically, purely resistive loads have a power factor of 1. A power factor of less than 1 indicates that there is energy storage in the load that may return power to the power supply out of phase with the power supply. The lower the power factor, the more wasted power.

LED bulb driver circuits typically have storage elements (e.g., capacitors) that may cause a lower power factor for the LED bulb as compared to an incandescent bulb. This results in an LED bulb that may put more strain on the power supply (i.e., the electrical grid) than is necessary.

LED bulb driver circuits may be modified with additional components or special circuits to improve the power factor. However, these modifications increase the volume occupied by the driver circuit. In space limited LED bulbs, it may be difficult to fit these additional components or special circuits. Additionally, the modifications may also make it more difficult for the LED bulb to work with common residential light dimmers.

BRIEF SUMMARY

A first exemplary embodiment of a light-emitting diode (LED) bulb has a shell and a base attached to the shell. The base is configured to connect to an electrical socket. An LED is within the shell. A driver circuit provides current to the LED. The driver circuit has a power factor control circuit that includes a tracking circuit configured to produce a tracking signal indicative of the voltage of the supply line. The power factor control circuit also includes a switch-mode power supply (SMPS) controller having an input pin and an output pin. The tracking circuit is connected to the input pin. Based on the signal at the input pin, the SMPS controller is configured to change a duty cycle of an output signal on the output pin.

A second exemplary embodiment of an LED bulb has a shell and a base attached to the shell. The base is configured to connect to an electrical socket. An LED is within the shell. A driver circuit provides current to the LED. The driver circuit has an input filter configured to produce a rectified voltage output based on an input line voltage. The driver circuit also has a switch-mode power supply (SMPS) controller connected to the input filter. The SMPS controller is configured to control a drive current to the LED. In response to an alternating current (AC) voltage input, the input filter is configured to store approximately zero energy from one cycle of the AC voltage input to the next cycle.

A first exemplary embodiment of a driver circuit for an LED bulb provides current to an LED. The driver circuit has a power factor control circuit that includes a tracking circuit configured to produce a tracking signal indicative of the voltage of the supply line. The power factor control circuit also includes a switch-mode power supply (SMPS) controller having an input pin and an output pin. The tracking circuit is connected to the input pin. Based on the signal at the input pin, the SMPS controller is configured to change a duty cycle of an output signal on the output pin.

A second exemplary embodiment of a driver circuit for an LED bulb provides current to an LED. The driver circuit has an input filter configured to produce a rectified voltage output based on an input line voltage. The driver circuit also has a switch-mode power supply (SMPS) controller connected to the input filter. The SMPS controller is configured to control a drive current to the LED. In response to an alternating current (AC) voltage input, the input filter is configured to store approximately zero energy from one cycle of the AC voltage input to the next cycle.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Figure 1:
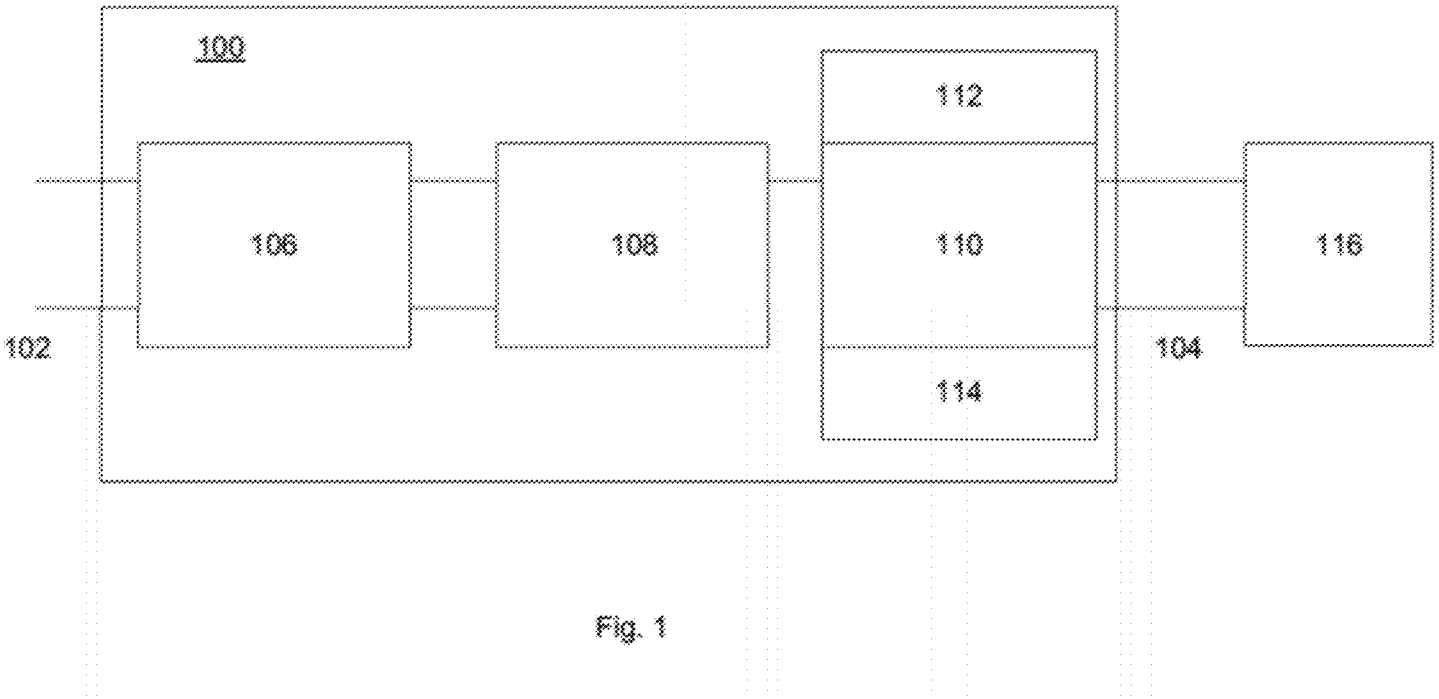
FIG. 1 depicts a block level schematic of an exemplary driver circuit with a thermal protection circuit.

FIG. 1 depicts a functional level diagram of exemplary driver circuit 100 utilizing a power factor control circuit. Driver circuit 100 may be used in an LED bulb to power one or more LEDs 116. Driver circuit 100 takes as input an input line voltage (e.g., 120 VAC, 60 Hz in the U.S.) at input 102 and outputs a current suitable for powering LEDs connected to output 104.

As will be described in more detail below, driver circuit 100 includes input protection circuit 106, input filter circuit 108, switched mode power supply (SMPS) circuit 110, thermal protection circuit 112, and power factor control circuit 114. Input protection circuit 106 is configured to protect driver circuit 100 and LEDs 116 from damage due to voltage spikes in the input line voltage or to prevent electrical shorts in the LED bulb from damaging the surrounding environment. Input protection circuit 106 is configured to also limit the input current when a switched voltage is first applied to input 102. Input filter circuit 108 is configured to condition the input line voltage for use with SMPS circuit 110, and to prevent noise generated by SMPS circuit 110 from reaching input 102 and affecting other devices connected to the input line voltage. SMPS circuit 110 is configured to convert the input line voltage to a current that is suitable for driving one or more LEDs 116. Thermal shutdown circuit 112 is configured to reduce or eliminate the current being supplied to LEDs 116 in the event that drive circuit 100, LEDs 116, or some other part of the LED bulb reaches a threshold temperature. Power factor control circuit 114 is configured to adjust the current that SMPS circuit 110 supplies to LEDs 116.

It should be recognized that some of the circuits shown in FIG. 1 may be omitted. For example, if an LED bulb is operating in a cold or sufficiently ventilated area, then thermal protection circuit 112 may not be necessary. Alternatively, the input protection may take place outside of the LED bulb, and therefore, input protection circuit 106 may not be necessary.

Figure 2A:
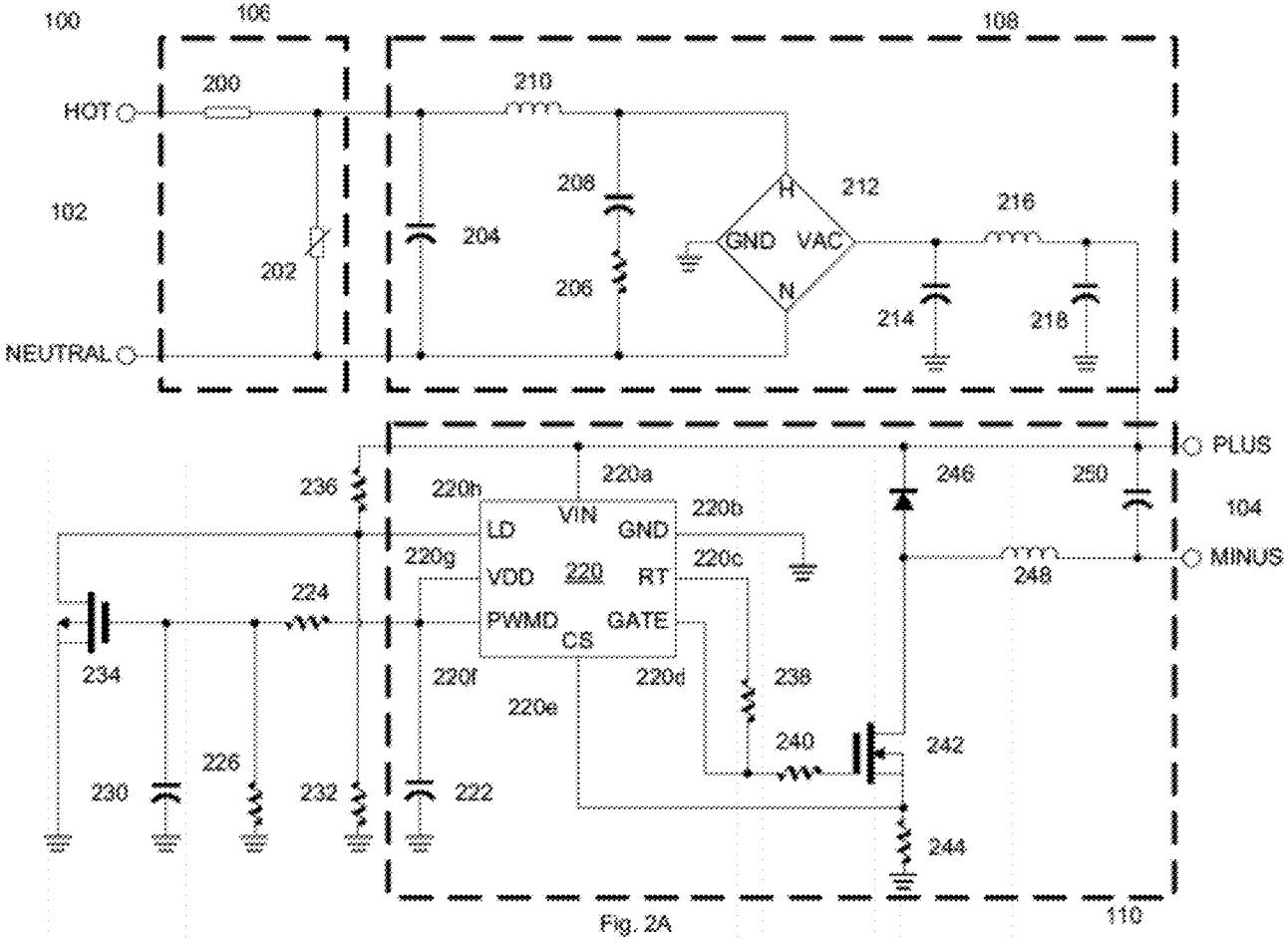
FIGS. 2A and 2B depict a component level schematic of the exemplary driver circuit with the thermal protection circuit.
Figure 2B:
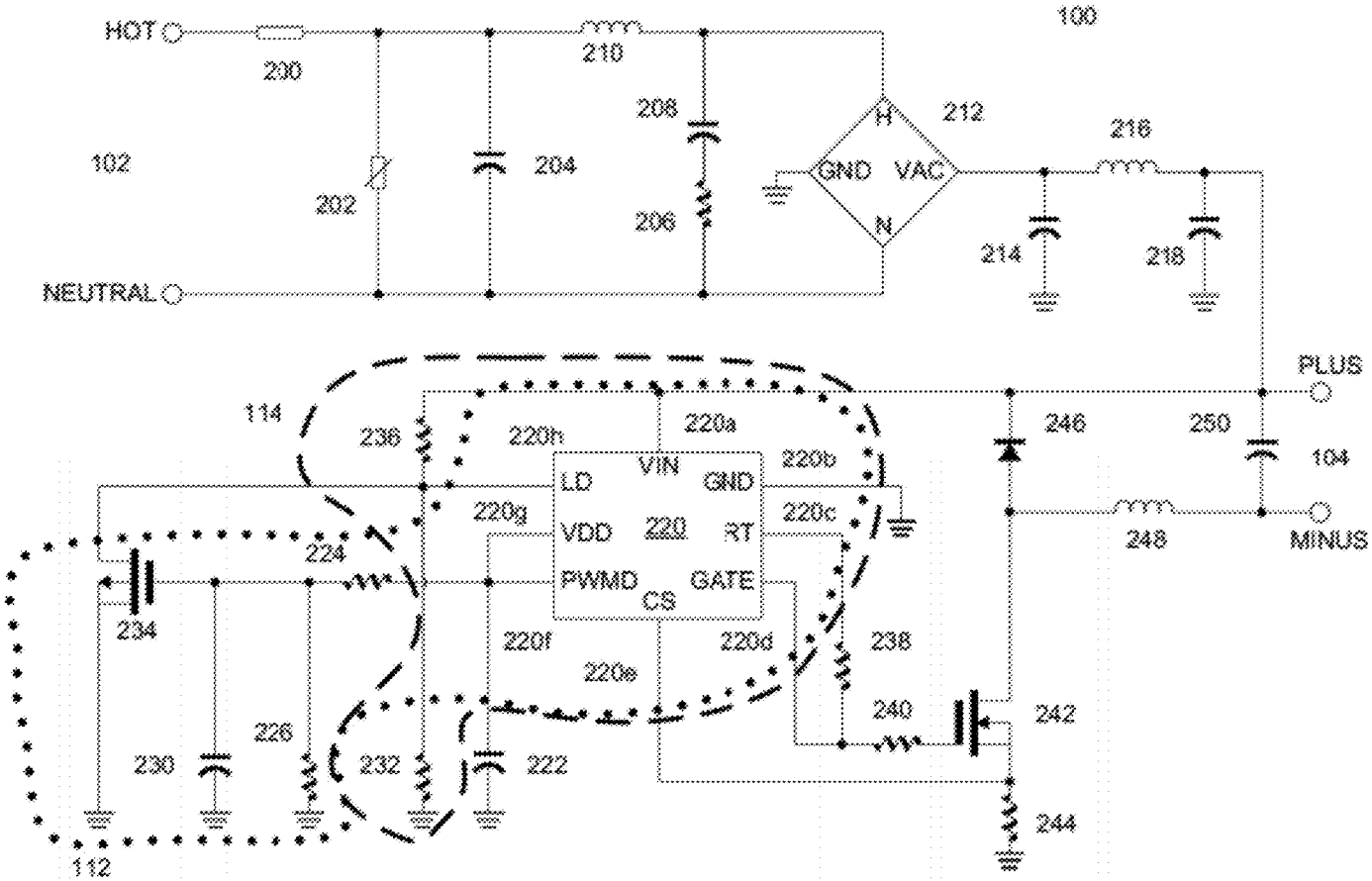

FIGS. 2A and 2B depict a component level schematic of driver circuit 100. The discussion below of the component level schematic lists several ranges, specific values, and part IDs for various components. It should be understood that these are not intended to be limiting. Other components values, parts, and ranges may also be used without deviating from a driver circuit using a thermal protection circuit as described herein. Additionally, while a specific circuit topology is presented in FIGS. 2A and 2B, a person skilled in the art will recognize that other topologies could be used without deviating from a driver circuit using a power factor control circuit as described herein.

Referring to FIG. 2A, SMPS circuit 110 includes: SMPS controller 220; switching element 242; resistors 238, 240, and 244; diode 246; inductor 248; and capacitor 250. SMPS controller 220 drives the switching speed and duty cycle of switching element 242, which controls the amount of current provided to the LEDs connected between output 104. Pins 220*a*-220*h* are input and output pins of SMS controller 220. In one example, SMPS controller 220 is implemented with an HV9910B controller made by Supertex Inc. If using the HV9910B IC or a similar controller, SMPS controller 220 may operate in either constant off-time or constant frequency mode.

In constant frequency mode (set by connecting resistor 238 between RT pin 220*c* and ground, the frequency of the output at GATE pin 220*d* is set by the value of resistor 238. The duty cycle of the output may then be set by resistor 244.

In constant off-time mode (set by connecting RT pin 220*c* to GATE pin 220*d* as shown in FIG. 2B), the duty cycle of the output at GATE pin 220*d* of SMPS controller 220 is set based on the value of resistor 238. The frequency of the output can then be varied with resistor 244, which is a current sense resistor that may cause the output at GATE pin 220*d* of SMPS controller 220 to reset to zero once a peak current has been reached through switching element 242, which is the same current as through the LEDs. As shown in FIGS. 2A and 2B, SMPS controller 220 is set for constant off-time mode because RT pin 220*c* is connected to GATE pin 220*d* through resistor 238.

Figure 3A:
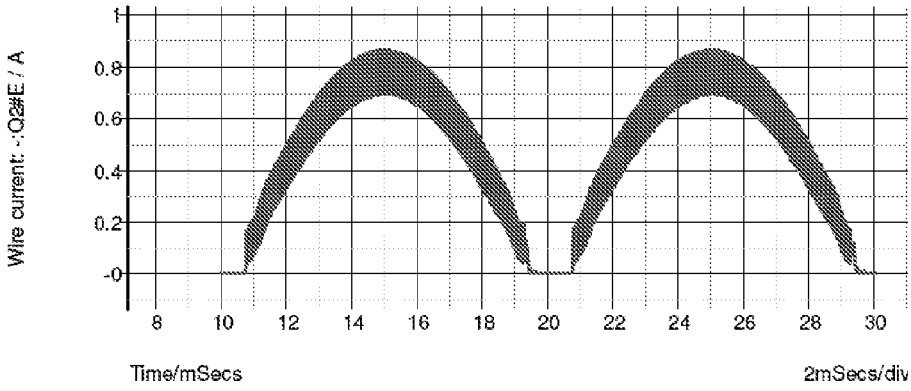
FIG. 3A depicts the drive current of an LED bulb driver circuit that does not limit the drive current.
Figure 3B:
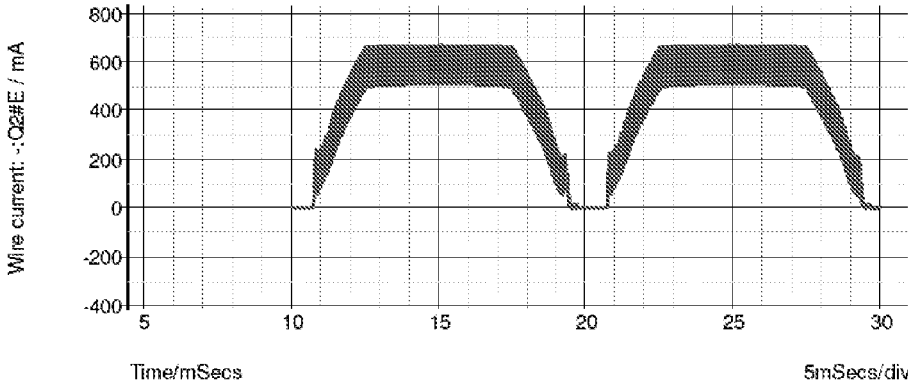
FIG. 3B depicts the drive current of an LED bulb driver circuit that limits the drive current.

Resistor 244 may be used to ensure that LEDs connected to output 104 are driven at the most efficient current level based on the required light output. FIG. 3A depicts the drive current through the LEDs in response to a 120 VAC 60 Hz input line voltage using a driver circuit design that does not limit the drive current. FIG. 3B depicts the drive current through the LEDs with the same input line voltage using driver circuit 100 where resistor 244 has been properly selected to limit the LED current to an efficient current level for the LEDs given a desired light output. Thus, by properly selecting resistor 244, the LEDs may operate at a more efficient and reliable level. Resistor 244 may be 180 mΩ.

The values for the other components in SMPS circuit 110 may be selected to provide suitable current to the LEDs connected to output 104, based on, among other factors, the input line voltage, the voltage drop across the LEDs, and the current required to drive the LEDs. For example, resistor 238 may be 300 kΩ, and resistor 240 may be 20Ω. Capacitor 222 is a hold-up capacitor to maintain VDD during switching, and may be 1 uF. Switching element 242 may be selected to operate properly with the operating range of SMPS controller 220 and to provide sufficient current for the LEDs. Switching element 242 may be an IRFR320PBF HEXFET Power MOSFET from International Rectifier. Diode 246 provides a current path for the current stored in inductor 248 to be supplied to the LEDs when switching element 242 is turned off. Diode 246 may be a IDD03SG60C SiC Schottky diode from Infineon Technologies. Capacitor 250 may filter the high frequency noise generated by the capacitance of the windings of inductor 248. Capacitor 250 may be 22 nF. Inductor 248 stores energy to supply current to LEDs connected to output 104 while switching element 242 is switched off. Inductor 248 may be an inductor of about 100 turns of 24 gauge, triple-insulated wire wound around a Magnetics CO55118A2 toroid core.

Referring to FIG. 2B, power factor control circuit 114 includes resistors 232 and 236, which form a tracking circuit that produces a signal that tracks the voltage that is output by input filter 108. Based on this signal, SMPS controller 220 may adjust the timing of switching element 242, which modifies the current being supplied to output 104. Resistors 232 and 236 may be 1.5 kΩ and 1 MΩ, respectively.

Power factor control circuit 112 uses linear dimmer (LD) pin 220*h* of SMPS controller 220. The voltage applied to LD pin 220*h* may change the timing of the output signal on GATE pin 220*d*, which in turn changes the timing of switching element 242. As the voltage on LD pin 220*h* is lowered, the duty cycle (if in constant-on time mode) of the output signal is decreased, which causes switching element 242 to stay in the off-state a longer portion of each switching cycle. The longer that switching element 242 is off during each switching cycle, the less current that is delivered to the LEDs that are connected across output 104, which causes the output of the LEDs to dim. If a zero voltage is applied to LD pin 220*h*, the duty cycle will drop to zero and no current will be delivered to output 104 and any connected LEDs will be off.

In a different implementation of SMPS controller 220, LD pin 220*h* starts to reduce the duty cycle of switching element 242 only when the voltage applied to LD pin 220*h* drops below a threshold value. In this example, changes in the voltage applied to LD pin 220*h* will not affect the duty cycle of switching element 242 if the voltage at LD pin 220*h* remains above the threshold value. However, if the voltage applied to LD pin 220*h* drops below the threshold value, then SMPS controller 220 will reduce the duty cycle as discussed in the previous paragraph.

In the above explanation of the operation of LD pin 220*h* to reduce the driver circuit output current and dim the LEDs, SMPS controller 220 was assumed to be in constant off-time mode. If SMPS controller 220 is instead in constant frequency mode, then LD pin 220*h* will operate a similar fashion, except instead of modulating the duty cycle of the output signal, the frequency of the output signal will change.

Power factor control circuit 114 improves the LED bulb's power factor by limiting the LED bulb's current consumption so that it tracks that of the input line voltage, which makes the LED bulb act more like an incandescent bulb (i.e., resistive load). Accordingly, an LED bulb using driver circuit 100 will supply current that is relatively in phase with the input voltage. In contrast, LED bulbs using other driver circuit designs that do not track the input voltage will supply current out of phase with the input voltage by supplying current to the LEDs even when the input voltage is zero between input cycles.

Referring back to FIG. 2A, input filter circuit 108 includes: capacitors 204, 210, 214, and 218; inductors 208 and 216; resistor 206; and bridge rectifier 212. Components for input filter circuit 108 should be selected to properly condition the input line voltage for use with SMPS circuit 110 and to prevent noise from SMPS circuit 110 from reaching input 102 and affecting other devices connected to the input line.

For example, if driver circuit 100 is connected to a 120 VAC, 60 Hz input line voltage, bridge rectifier 212 may be a 400V diode bridge rectifier. Capacitor 204 may be selected to suppress high frequencies generated by SMPS circuit 110 and may be 2.2 nF. Inductors 208 and 216 may be 1-2 mH inductors or more specifically, about 200 turns of 36 gauge wires wound around a Magnetics CO58028A2 toroid core. The damping network of resistor 210 and capacitor 206 may help minimize ringing of driver circuit 100 when input 102 is connected to the input line voltage through a residential dimmer. Resistor 210 may be 120Ω and capacitor 206 may be 680 nf. Filter capacitors 214 and 218 may be 100 nF.

To further improve power factor of an LED bulb, driver circuit 100 stores very little energy from once cycle of the input line voltage to the next. This is in contrast to conventional driver circuits that use large storage capacitors to store energy between cycles of the input line voltage.

Figure 4A:
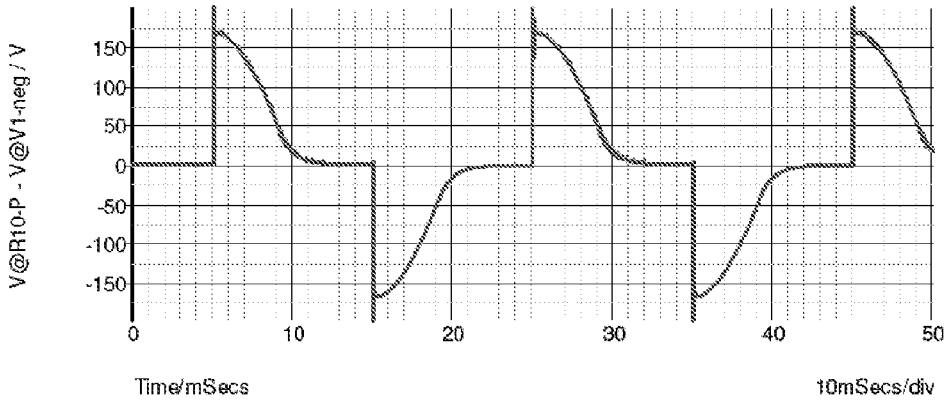
FIG. 4A depicts the input to an input filter of an LED bulb driver circuit.
Figure 4B:
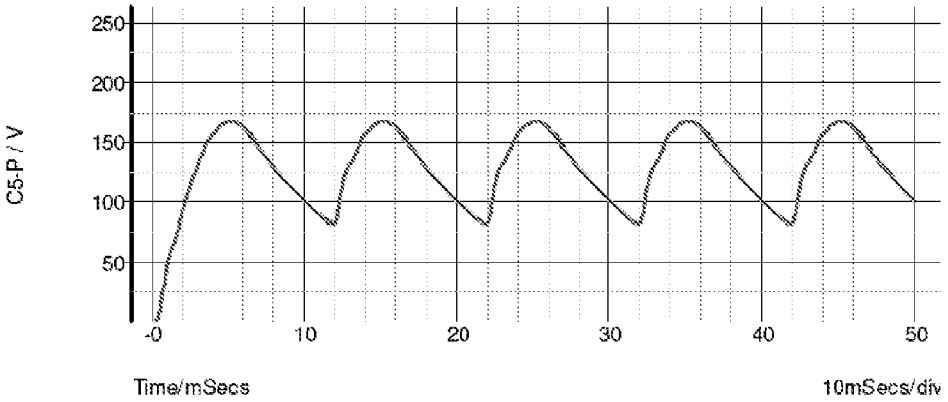
FIG. 4B depicts the output from an input filter of an LED bulb driver circuit with energy storage.

For example, consider a voltage input coming from a residential dimmer that is dimmed to 50%. FIG. 4A depicts this voltage signal. In other driver circuit designs that store energy between input cycles, FIG. 4B depicts the voltage at the output of the input filter. Because the other driver circuit designs store significant amounts of energy, the output of the filter doesn't reach zero when the input voltage goes to zero at the start of each cycle.

Figure 4C:
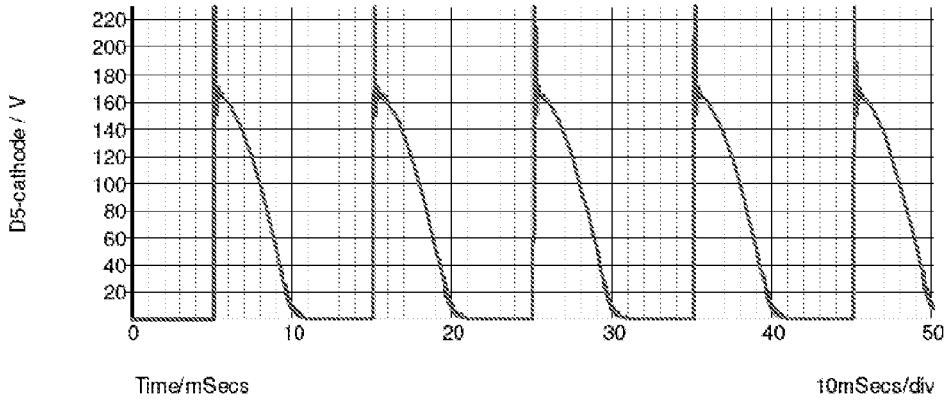
FIG. 4C depicts the output from an input filter of an LED bulb driver circuit with zero energy storage.

In contrast, FIG. 4C depicts the output voltage from input filter 108 in response to the voltage signal depicted in FIG. 4A being applied to input 102 of the exemplary embodiment of driver circuit 100 described above. Because the driver circuit does not store significant amounts of energy in input filter 108, the output of input filter 108 returns to zero about the same time that the input voltage returns to zero. Again, the LED bulb will act more like a resistive load, which typically has a higher power factor.

The minimal energy storage of driver circuit 100 is based on the small sizes of the capacitors in input filter 108, especially capacitors 214 and 218. In other driver circuit designs with more energy storage, these capacitors may be up to tens of microfarads or more. Electrolytic capacitors may have to be used to reach these capacitances. However, electrolytic capacitors may have reliability concerns over the targeted long lifetime of LED bulbs and at the elevated operating temperatures typical of LED bulbs. Electrolytic capacitors may also be difficult to fit within an LED bulb. Therefore, the minimal energy storage of driver circuit 100 may also allow for use of ceramic capacitors, which may improve reliability and use less space.

Another potential benefit of the low energy storage is that an LED bulb using driver circuit 100 may not need any additional circuitry to dim the LEDs in response to a residential dimmer because the output of the input filter is already representative of the dimmer output. In contrast, LED bulbs using other driver circuit designs with more energy storage may need additional components to dim the LEDs because the output of the input filter is not representative of the input line voltage.

Referring back to FIG. 2A, input protection circuit 106 includes fuse 200 that protects against short circuits in the rest of the driver circuit or LEDs and varistor 202 that protects against voltage spikes in the input line voltage. For example, fuse 200 may be a 250 mA slow blow micro fuse and varistor may be a 240V-rated metal oxide varistor.

Referring to FIG. 2B, thermal protection circuit 112 includes transistor 234, thermistor 226, and resistor 224. Thermal protection circuit 112 also uses SMPS controller 220. In the exemplary embodiment, thermistor 228 is implemented as a positive temperature coefficient (PTC) thermistor. A PTC thermistor behaves as a normal low-value resistor at nominal operating temperatures (i.e., the resistance changes slowly as temperature changes). At low resistance values of thermistor 226, the gate of transistor 234 will stay low and transistor 234 will remain turned off. However, once the operating temperature passes a switching temperature, the resistance of the PTC thermistor 228 increases rapidly with increasing temperature. As the resistance of thermistor 228 rises, transistor 234 starts to turn on and pull down the voltage of LD pin 220*h*. This may cause a similar change in the timing of the signal on GATE pin 220*d* as discussed above with respect to power factor control circuit 114. Transistor 234 may be a BSS123 Power n-channel MOSFET from Weitron Technology. Resistor 224 is a pull-up resistor to ensure that the gate of transistor 234 does not float at high resistance values of thermistor 228. Resistor 224 may be 100 kΩ. Capacitor 230 is a filter that ensures transistor 234 does not cause the LED bulb to behave erratically by switching on and off too quickly. Capacitor 230 may be 4.7 uF.

Figure 5:
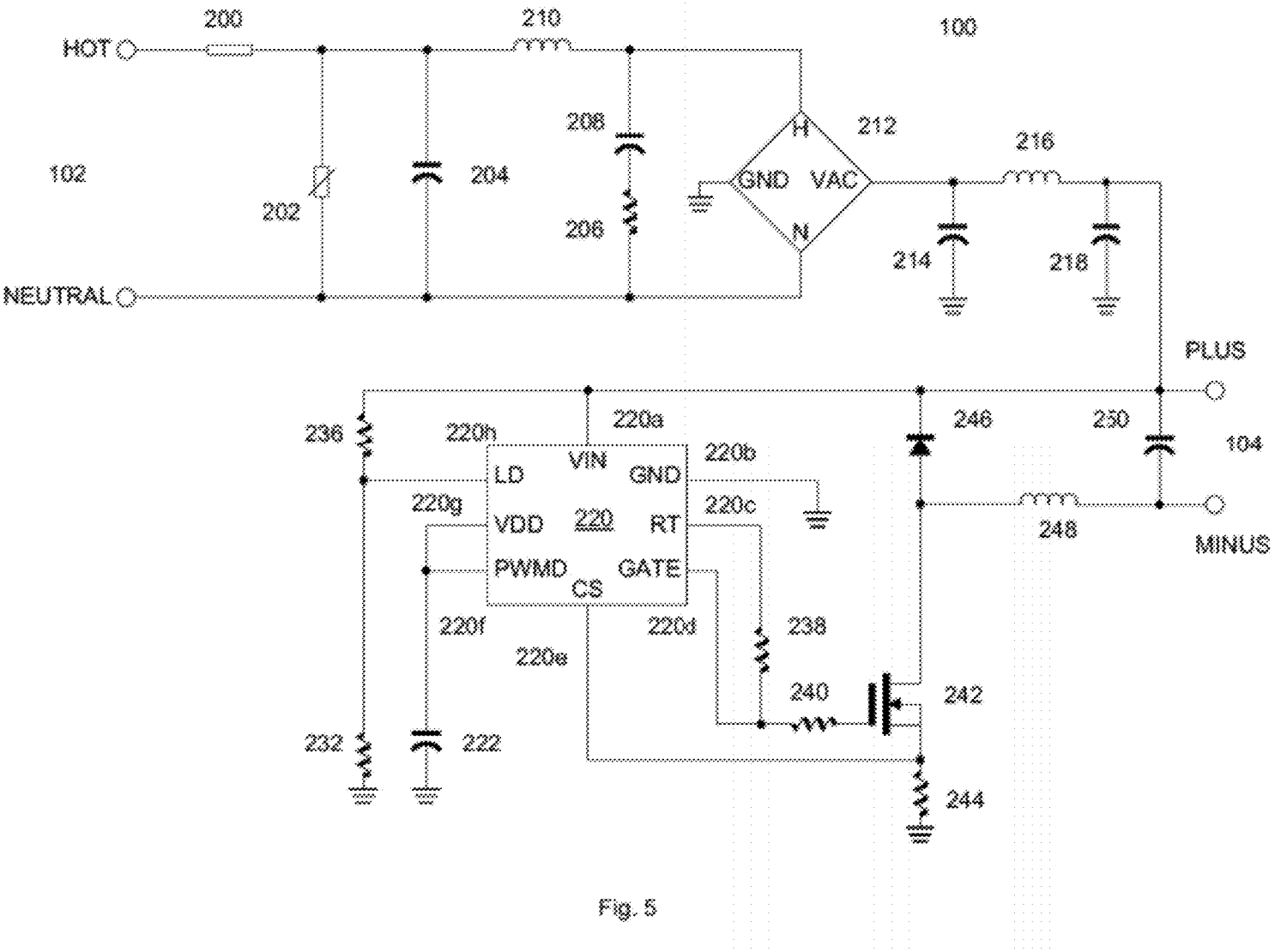
FIG. 5 depicts an alternative exemplary embodiment of an LED bulb driver circuit with a power factor control circuit.

FIG. 5 depicts alternative exemplary driver circuit 500. Driver circuit 500 is similar to driver 100 (FIG. 1) except driver circuit 500 does not include temperature protection circuit 112 (FIG. 2B).

Figure 6:
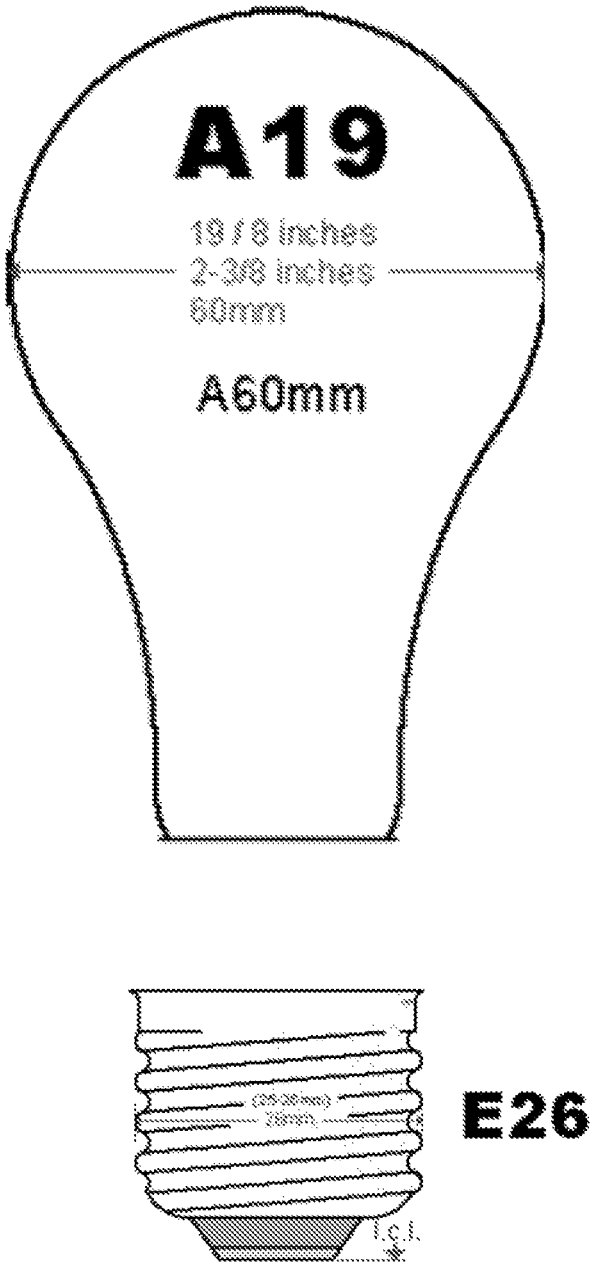
FIG. 6 depicts an A19 bulb/shell and E26 connector found in a common light bulb form factor.

FIG. 6 depicts the A19 bulb and E26 base of a common lamp bulb form factor in the United States. LED bulbs must often fit all required components, including the driver circuit, heat sinks, and LEDs, within the A19 bulb and E26 connector. As such, the size and weight of the driver circuit is a significant design consideration because of the limited volume available in the A19 bulb and E26 connector enclosures. LED bulbs meant as replacements for common lamp bulbs in other countries are also limited to comparable volumes.

Figure 7:
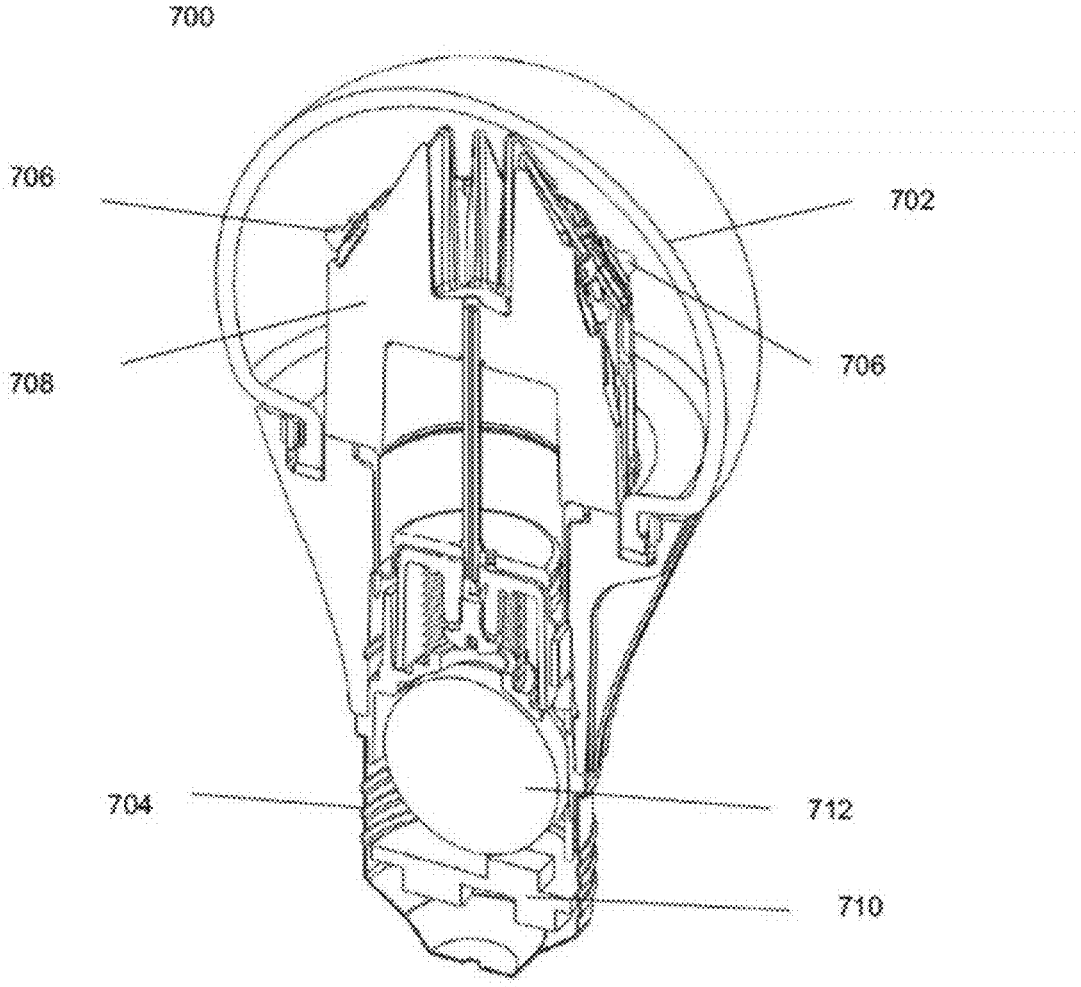
FIG. 7 depicts an exemplary LED bulb that uses a driver circuit with a power factor control circuit.

FIG. 7 depicts an exemplary LED bulb 700 with shell 702 and base 704. The LED bulb contains LEDs 706, heat sink 708, and driver circuit 710. In exemplary LED bulb 700, driver circuit 710 may be the driver circuit discussed above with respect to FIGS. 2A and 2B and is substantially contained within 704 base. In this context, substantially contained means that the majority of the driver circuit is within base 704 but portions of driver circuit components may be protruding from base 704. For example, the top part of inductor 712 may protrude above base 704 into heat sink 708 or shell 702 if the shell is connected directly to base 704. Additionally, substantially contained also means that one or more thermistors or other temperature-sensitive components may be located outside of base 704 if temperatures at locations other than driver circuit 710 are to be monitored. For example, one thermistor may be located on driver circuit 710 in base 704, while a second thermistor may be located on heat sink 708 or within shell 702. In these examples, driver circuit 710 is still substantially contained in base 704.

Although a feature may appear to be described in connection with a particular embodiment, one skilled in the art would recognize that various features of the described embodiments may be combined. Moreover, aspects described in connection with an embodiment may stand alone.

What is claimed is:

1. A light-emitting diode (LED) bulb comprising:

a shell;

an LED contained within the shell;

a driver circuit for providing current to the LED, the driver circuit having a power factor control circuit that comprises:

a tracking circuit connected to a supply line to the LED, wherein the tracking circuit is configured to produce a tracking signal indicative of the voltage of the supply line;

a switch-mode power supply (SMPS) controller having an input pin and an output pin, wherein the tracking circuit supplies the tracking signal to the input pin, wherein, in response to the tracking signal being below a threshold voltage, the SMPS controller is configured to change a duty cycle of an output signal on the output pin based on the tracking signal, and wherein, in response to the tracking signal being above a threshold voltage, the SMPS controller is configured to provide the output signal on the output pin independent of the tracking signal; and a base attached to the bulb for connecting the LED bulb to an electrical socket.

2. The LED bulb of claim 1, wherein the driver circuit substantially fits within the base.

3. The LED bulb of claim 1, wherein, as the voltage supply of the supply line increases, the duty cycle also increases.

4. The LED bulb of claim 1, wherein the tracking circuit includes a first resistor connected between the supply line and the input pin and a second resistor connected between the input pin and ground.

5. The LED bulb of claim 1, wherein the SMPS controller is configured to limit a current supplied to the LED through the input supply line.

6. The LED bulb of claim 5, wherein the SMPS controller is configured to limit the current based on a sense signal from a current sense resistor.

7. The LED bulb of claim 6, wherein the current sense resistor is connected between the LED and ground.

8. The LED bulb of claim 1, wherein the SMPS controller is configured to modulate the output signal based on the sense signal.

9. The LED bulb of claim 1, wherein the driver circuit further comprises an input filter circuit.

10. The LED bulb of claim 1, wherein the driver circuit is configured to accept an alternating current (AC) supply voltage.

11. A light-emitting diode (LED) bulb driver circuit having a power factor control circuit comprising:

a tracking circuit connected to a supply line for an LED, wherein the tracking circuit is configured to produce a tracking signal indicative of the voltage of the supply line; and a switch-mode power supply (SMPS) controller having an input pin and an output pin, wherein the tracking circuit supplies the tracking signal to the input pin, wherein, in response to the tracking signal being below a threshold voltage, the SMPS controller is configured to change a duty cycle of an output signal on the output pin based on the tracking signal, and wherein, in response to the tracking signal being above a threshold voltage, the SMPS controller is configured to provide the output signal on the output pin independent of the tracking signal.

12. The driver circuit of claim 11, wherein, as the voltage supply of the supply line increases, the duty cycle also increases.

13. The driver circuit of claim 11, wherein the tracking circuit includes a first resistor connected between the supply line and the input pin and a second resistor connected between the input pin and ground.

14. The driver circuit of claim 11, wherein the SMPS controller is configured to limit a current supplied to the LED through the input supply line.

15. The driver circuit of claim 14, wherein the SMPS controller is configured to limit the current based on a sense signal from a current sense resistor.

16. The driver circuit of claim 15, wherein the current sense resistor is connected between an LED and ground.

17. The driver circuit of claim 11, wherein the SMPS controller is configured to modulate the output signal based on the sense signal.

18. The driver circuit of claim 11, wherein the driver circuit further comprises an input filter circuit.

19. The driver circuit of claim 11, wherein the driver circuit is configured to accept an alternating current (AC) supply voltage.

20. The driver circuit of claim 11, wherein the driver circuit further comprises:

a switching transistor is connected to the output pin of the SMPS controller.

* * * * *